US008777673B2

(12) United States Patent
Sun et al.

(10) Patent No.: US 8,777,673 B2
(45) Date of Patent: Jul. 15, 2014

(54) SOCKET AND PLUG FOR HIGH-SPEED CONNECTOR

(71) Applicant: Huawei Technologies Co., Ltd., Guangdong (CN)

(72) Inventors: Baoliang Sun, Shenzhen (CN); Min Song, Shenzhen (CN); Tengfang Xiong, Shenzhen (CN); Wanxing Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 82 days.

(21) Appl. No.: 13/758,718

(22) Filed: Feb. 4, 2013

(65) Prior Publication Data

US 2013/0149913 A1 Jun. 13, 2013

Related U.S. Application Data

(63) Continuation of application No. PCT/CN2011/079671, filed on Sep. 15, 2011.

(30) Foreign Application Priority Data

Jan. 31, 2011 (CN) ..... 2011 1 0033878

(51) Int. Cl.
*H01R 24/00* (2011.01)

(52) U.S. Cl.
USPC ..... 439/660

(58) Field of Classification Search
USPC ..... 439/60, 660, 637
See application file for complete search history.

(56) References Cited

U.S. PATENT DOCUMENTS 5,051,099 A * 9/1991 Pickles et al. ..... 439/108
5,197,887 A * 3/1993 Davidge et al. ..... 439/60
(Continued)

FOREIGN PATENT DOCUMENTS

| | | | |
|---|---|---|---|
| CN | 2840355 | Y | 11/2006 |
| CN | 101800370 | A | 8/2010 |
| CN | 201682145 | U | 12/2010 |
| CN | 101944700 | A | 1/2011 |

OTHER PUBLICATIONS

Foreign communication from a counterpart application, PCT application PCT/CN2011/079671, English Translation International Search Report dated Dec. 22, 2011, 3 pages.
Foreign Communication From a Counterpart Application, PCT Application PCT/CN2011/079671, Partial English Translation of Written Opinion dated Dec. 22, 2011, 6 pages.

(Continued)

*Primary Examiner* — Phuong Dinh
(74) *Attorney, Agent, or Firm* — Conley Rose, P.C.; Grant Rodolph; Nicholas K. Beaulieu

(57) ABSTRACT

A socket and a plug for a high-speed connector configured to implement communication and transmission of multiple channels of high-speed signals are disclosed. The socket according to an embodiment of the present invention includes: a shell and pins; the shell has an opening configured to accommodate a plug for the high-speed connector; the pins include upper-layer pins and lower-layer pins; the upper-layer pins are set at one side of an inner wall of the opening, the lower-layer pins are set at the other side of the inner wall of the opening corresponding to positions of the upper-layer pins, the upper-layer pins are arranged in at least two rows of pin groups, and the at least two rows of pin groups are distributed in a staggered manner along a length direction of the pins.

10 Claims, 3 Drawing Sheets

(56) References Cited

U.S. PATENT DOCUMENTS

| | | | | |
|---|---|---|---|---|
| 7,165,977 | B2 | 1/2007 | Jiang et al. | |
| 7,572,146 | B1 | 8/2009 | Chiang | |
| 2004/0072467 | A1 * | 4/2004 | Jordan et al. | 439/492 |
| 2006/0228913 | A1 | 10/2006 | Jiang et al. | |
| 2010/0081297 | A1 * | 4/2010 | Miller | 439/60 |

OTHER PUBLICATIONS

Foreign Communication From a Counterpart Application, Chinese Application No. 2011/0033878.1, Chinese Office Action dated Jul. 18, 2013, 6 pages.

Foreign Communication From a Counterpart Application, Chinese Application No. 2011/0033878.1, Partial EnglishTranslation of Chinese Office Action dated Jul. 18, 2013, 4 pages.

* cited by examiner

SOCKET AND PLUG FOR HIGH-SPEED CONNECTOR

CROSS-REFERENCE TO RELATED APPLICATIONS

This application is a continuation of International Application No. PCT/CN2011/079671, filed on Sep. 15, 2011, which claims priority to Chinese Patent Application No. 201110033878.1, filed on Jan. 31, 2011, both of which are hereby incorporated by reference in their entireties.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to the field of electronic connection devices, and in particular, to a socket and a plug for a high-speed connector.

BACKGROUND

Small form-factor pluggables (SFP) high-speed interface connectors are widely used in communications products, and are important service interfaces. SFP high-speed interface connectors may be applied to: Common Public Radio Interface (CPRI) interfaces, gigabit Ethernet (GE) interfaces, fast Ethernet (FE) interfaces, and so on. As the requirements for bandwidth of communications products grow continuously, an SFP connector supports only one channel of high-speed signal, and gradually cannot meet the requirements for bandwidth development of communications products.

To meet the requirements for multiple channels of high-speed transmission, a four-channel SFP (e.g., a Quad Small Form-factor Pluggable (QSFP)) connector emerges in the prior art. The QSFP connector supports transmission of a maximum of four channels of high-speed signals. However, the pins of the socket of such a QSFP connector adopt single-row distribution in a straight line, resulting in a long interface end of the socket, and a large volume of the socket. In addition, a QSFP plug with the matching length is required.

SUMMARY

Embodiments of the present invention provide a socket and a plug for a high-speed connector configured to implement communication and transmission of multiple channels of high-speed signals.

The socket for the high-speed connector according to the present invention includes: a shell and pins; the shell has an opening configured to accommodate a plug for the high-speed connector; the pins include upper-layer pins and lower-layer pins; the upper-layer pins are set at one side of an inner wall of the opening, the lower-layer pins are set at the other side of the inner wall of the opening corresponding to positions of the upper-layer pins, the lower-layer pins are arranged in at least two rows of pin groups, and the at least two rows of pin groups are distributed in a staggered manner along a length direction of the pin; the upper-layer pins correspond to one row of the pin groups.

The plug for the high-speed connector according to the present invention includes: a circuit board and pin terminals; the pin terminals include first pin terminals and second pin terminals; the first pin terminals are set on one surface of the circuit board and the second pin terminals are set on the other surface of the circuit board; the second pin terminals are arranged in at least two rows of pin terminal groups, and the at least two rows of pin terminal groups are distributed in a staggered manner along a length direction of the pin terminal; the first pin terminals correspond to one row of the pin terminal groups.

From the technical solutions, it may be seen that the embodiments of the present invention have the following advantages: the lower-layer pins of the socket for the high-speed connector in the present invention are arranged in at least two rows of pin groups, and the at least two rows of pin groups are arranged in a staggered manner along the length direction of the pin. Such a distribution mode greatly reduces the length of the opening of the socket for the high-speed connector, efficiently uses the vertical space of the socket, reduces the overall volume of the socket for the high-speed connector, and facilitates installation and layout of the socket for the high-speed connector.

DETAILED DESCRIPTION

Embodiments of the present invention provide a socket and a plug for a high-speed connector configured to implement communication and transmission of multiple channels of high-speed signals.

The terms "upper/lower" and "positive/reverse" in the descriptions of the embodiments of the present invention do not strictly restrict the locations, but are relative concepts that are intended to help define the relative position relationship of the structure of an object.

Figure 1:
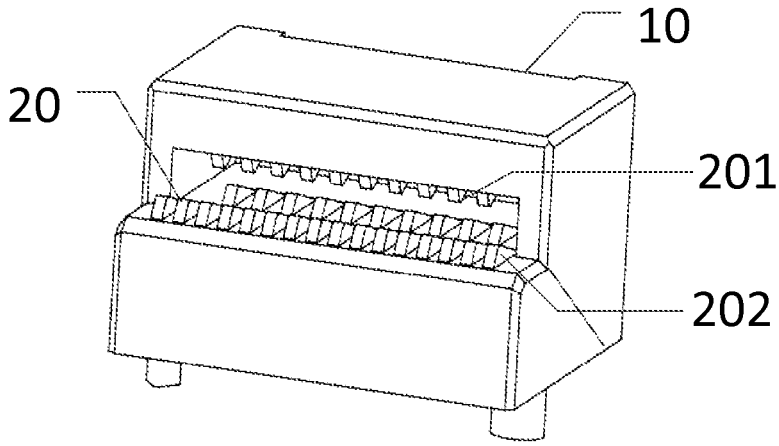
FIG. 1 is a front schematic diagram of a socket for a high-speed connector according to an embodiment of the present invention.

As shown in FIG. 1, an embodiment of a socket for a high-speed connector in the embodiment of the present invention includes:

A switch connector in the embodiment of the present invention mainly includes the following parts: a shell 10 and pins 20.

The shell 10 has an opening that allows insertion of a plug for a high-speed connector; and the pins 20 include: upper-layer pins 201 and lower-layer pins 202; the upper-layer pins 201 are generally configured to transmit ordinary signals, such as ground signals, send fault signals, continuous data signals, continuous from beginning to end signals, and frequency select signals; the lower-layer pins 202 are configured to transmit high-speed signals, such as positive emitter coupled logic (PECL) signals.

The upper-layer pins 201 are set on one side of an inner wall of the opening, and the lower-layer pins 202 are set at the other side of the inner wall of the opening corresponding to positions of the upper-layer pins 201. The lower-layer pins 202 are arranged in at least two rows of pin groups, and the at least two rows of pin groups are distributed in a staggered manner along a length direction of the pin 20; the upper-layer pins 201 correspond to one row of the pin groups.

Contacts of the upper-layer pins 201 and the lower-layer pins 202 are elastic parts. The elastic parts may be bent metal springs. Tail ends of the upper-layer pins 201 and lower-layer pins 202 are fixed at a bottom of a groove in a fuse connection or crimp connection mode. A contact of the pin 20 is configured to connect a pin terminal of the plug for the high-speed connector, and a tail end of the pin 20 may be electrically connected to a circuit board of a terminal as a signal interface.

In a manufacturing technique, a punching machine may be used to form multiple groups of grooves for placing the pins in the shell 10. Each group of grooves has multiple separate grooves neatly distributed in rows. The width of each groove matches the width of each pin 20. The tail end of the pin is fixed at the bottom of the groove in the fuse connection or crimp connection mode, ensuring mechanical strength of the pin 20 in the groove, so that the contacts of the pins 20 may precisely correspond to the pin terminals of the plug when the socket for the high-speed connector is connected to the plug.

In addition, to ensure that the positions of the plug and the socket are relatively fixed after the plug for the high-speed connector is inserted into the socket for the high-speed connector of the present invention, a positioning groove may be built on the inner wall of the opening of the shell 10 in the embodiment of the present invention.

The lower-layer pins of the socket for the high-speed connector of the present invention are arranged in at least two rows of pin groups, and the at least two rows of pin groups are arranged in the staggered manner along the length direction of the pin. Such a distribution mode greatly reduces the length of the opening of the socket for the high-speed connector, efficiently uses the vertical space of the socket, reduces the overall volume of the socket for the high-speed connector, and facilitates installation and layout of the socket for the high-speed connector.

Figure 2:
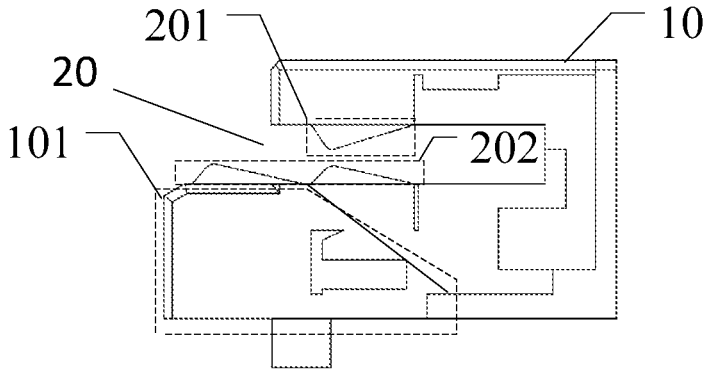
FIG. 2 is a profile schematic diagram of a socket for a high-speed connector according to an embodiment of the present invention.

As many high-speed communications devices on the market currently still use SFP plugs, it is difficult to upgrade multi-channel high-speed connectors once and for all. Therefore, the present invention provides a technical solution that allows SFP plugs to smoothly upgrade. As shown in FIG. 2, another embodiment of the socket for the high-speed connector in the embodiment of the present invention includes: a shell 10 and pins 20.

The shell 10 has an opening that allows insertion of a plug for an SFP connector. An extension support 101 is embedded below an inner wall of the opening of the shell 10. The extension support 101 is also distributed with several rows of grooves. Lower-layer pins 202 may be placed in the grooves.

The pins 20 include: upper-layer pins 201 and lower-layer pins 202. The upper-layer pins 201 are set at one side of the inner wall of the opening of the shell 10, and the lower-layer pins 202 are set at the other side of the inner wall of the opening. The lower-layer pins 202 are arranged in at least two rows of pin groups, and the at least two rows of pin groups are distributed in a staggered manner along a length direction of the pin 20. The other side of the inner wall corresponding to positions of the upper-layer pins 201 is distributed with one row of pin groups, the pin group is distributed at the innermost side of the opening of the shell 10, and the rest of the pin groups are distributed on the extension support 101.

In actual applications, to facilitate cable layout, among the at least two rows of pin groups in the embodiment of the present invention, a distance between neighboring pins in at least one row of pin groups is different from a distance between neighboring pins in another neighboring row of pin groups, so that layout of data transmission lines on the pins may be staggered along the length direction of the pin 20, fully utilizing the space.

Certain devices on the market currently still use the SFP plugs, and a distance between pin terminals of an SFP plug is large. Therefore, in the socket for the high-speed connector in the embodiment of the present invention, to ensure compatibility with an SFP plug, the distribution mode of the upper-layer pins 201 and the lower-layer pins 202 corresponding to the positions of the upper-layer pins 201 is consistent with the distribution mode of the pin terminals of the SFP plug.

The distribution mode of the pins 20 in the embodiment of the present invention is specifically as follows: There are 20 upper-layer pins 201, and the distance between two neighboring upper-layer pins 201 is 0.8 millimeters (mm); likewise, a row of pin groups corresponding to the positions of upper-layer pins 201 has also 20 lower-layer pins 202, and the distance between two neighboring pins is also 0.8 mm; each of the rest rows of pin groups has 36 lower-layer pins 202, and the distance between two neighboring pins is 0.65 mm.

The distribution mode being consistent includes: the number of pins 20 (or pin terminals) being consistent and the distance between pins (or pin terminals) being consistent.

In this manner, the upper-layer pins 201 and the lower-layer pins 202 corresponding to the upper-layer pins 201 may correspond to the pin terminals of the SFP plug, and the rest lower-layer pins 202 may also use a relatively high-density arrangement mode, ensuring compatibility with the SFP plug and transferring data signals as many as possible.

In the embodiment of the present invention, the socket for the high-speed connector according to the present invention may accommodate an SFP plug in the prior art. After the SFP plug is inserted into the socket for the high-speed connector according to the present invention, as the number of pins of the socket is the same as the number of pin terminals of the SFP plug, and the distance between the pins is consistent with the distance between the pin terminals, all the pin terminals match the pins after insertion, and electrical connection may be implemented.

Considering the size match of the SFP plug in the prior art, to prevent the pin terminals of the SFP plug from failing to contact the matching pins 20 after insertion due to a large depth of the opening of the shell of the socket for the high-speed connector in the present invention as the number of lower-layer pins 202 is large, in the embodiment of the present invention, except for the lower-layer pins 202 corresponding to the positions of the upper-layer pins 201, all the rest lower-layer pins 202 are distributed on the extension support 101. The extension support 101 may be attached to the place below the inner wall of the opening of the shell 10 in an assembly manner. When the extension support 101 is embedded below the inner wall of the opening of the shell 10, all the lower-layer pins 202 on the extension support 101 are connected to communication links in the socket for the high-speed connector; when the extension support 101 is detached from the shell 10, the depth of the opening of the shell may be reduced, so that the pin terminals may be electrically connected to the corresponding pins 20 when the SFP plug is inserted into the shell 10.

Figure 3A:
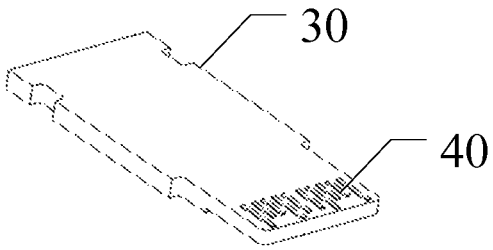
FIG. 3A and FIG. 3B are two-side schematic diagrams of a plug for a high-speed connector according to an embodiment of the present invention.
Figure 3B:
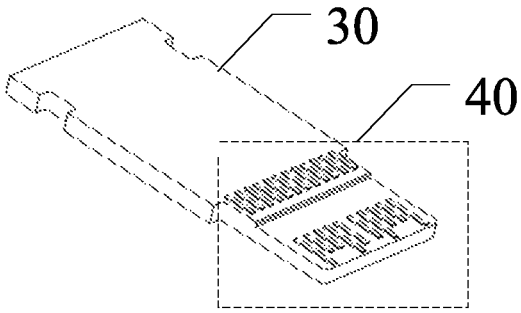

The present invention further provides a plug for a high-speed connector that matches the socket for the high-speed connector. As shown in FIG. 3A and FIG. 3B, an embodiment of the plug for the high-speed connector in the embodiment of the present invention includes: a circuit board 30 and pin terminals 40.

Pin terminals 40 include first pin terminals and second pin terminals.

The first pin terminals are set on one surface of the circuit board 30 and the second pin terminals are set on the other surface of the circuit board 30.

The second pin terminals are arranged in at least two rows of pin terminal groups, and the at least two rows of pin terminal groups are distributed in a staggered manner along a length direction of the pin terminal 40; the first pin terminals correspond to one row of the pin terminal groups.

A distribution mode of the first pin terminals is consistent with a distribution mode of the upper-layer pins 201 in the socket for the high-speed connector according to the embodiment.

A distribution mode of the second pin terminals is consistent with a distribution mode of each row of lower-layer pins 202 in the socket for the high-speed connector according to the embodiment.

A signal transmission circuit is distributed in the circuit board 30. Output ends of the signal transmission circuit are connected to the pin terminals 40. Input ends of the signal transmission circuit are connected to various signal lines (such as ground signal, send fault signal, continuous data signal, continuous from beginning to end signal, frequency select signal, and PECL signal data lines) through soldering connection or crimp connection.

The thickness of the circuit board 30 basically matches the width of the opening of the shell 10 in the preceding embodiment. After the circuit board 30 is inserted into the opening of the shell 10, the pins 20 in the opening of the shell 10 may be pressed on the circuit board 30, maintaining a certain contact force.

In addition, to allow the positions of the plug and the socket to be relatively fixed after the plug for the high-speed connector is inserted into the socket for the high-speed connector according to the present invention, in the embodiment of the present invention, a side of the circuit 30 may further carry a positioning clip. The positioning clip matches the positioning groove in the embodiment of the socket for the high-speed connector.

In actual applications, to facilitate cable layout, among the at least two rows of pin terminals of the embodiment of the present invention, the distance between neighboring pin terminals in at least one row of pin terminals is different from the distance between neighboring pin terminals in another neighboring row of pin terminals, so that layout of data transmission lines of the pin terminals may be staggered along the length direction of the pin terminal 40, fully utilizing the space.

In this embodiment, to match the socket for the high-speed connector that is compatible with the SFP plug in the prior art, the plug for the high-speed connector according to the present invention may further include the following characteristics:

The distribution mode of the first pin terminals and corresponding second pin terminals is consistent with the distribution mode of the pin terminals of the SFP plug.

The distribution mode of the pin terminals 40 in this embodiment is specifically as follows: There are 20 first pin terminals arranged in one row, and the distance between two neighboring first pin terminals is 0.8 mm; the second pin terminals are arranged in at least two rows of pin terminal groups along the length direction of the pin terminal, the distance between neighboring pin terminals in the row of pin terminal groups corresponding to the first pin terminals is also 0.8 mm, and the row of pin terminal groups has 20 second pin terminals; the distance between neighboring pin terminals in each of the rest rows of pin terminal groups is 0.65 mm, and each row of pin terminal groups has 36 second pin terminals.

The surface of the circuit board 30 distributed with the second pin terminals is a ladder structure of at least two layers. The row of pin terminal groups corresponding to the first pin terminals are distributed on the bottom plane in the ladder structure. The rest rows of pin terminal groups are respectively distributed on the planes of the rest layers in the ladder structure. Such design can avoid short circuit due to contact of unmatched pin terminals 40 and pins 20 when the circuit board 30 is inserted into the opening of the shell 10.

Figure 4A:
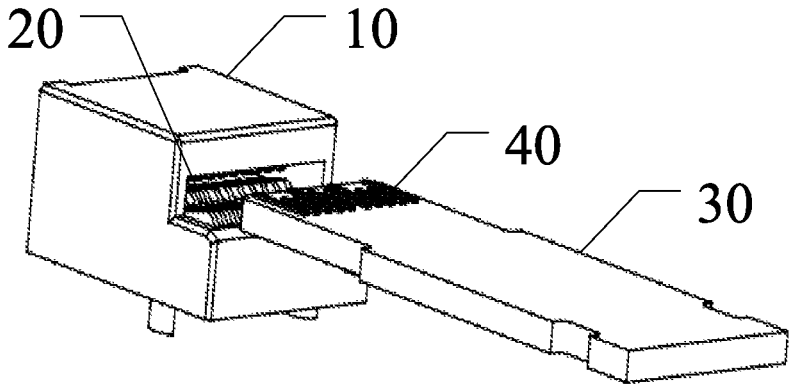
FIG. 4A and FIG. 4B are schematic diagrams of a connection between a plug and a socket for a high-speed connector according to an embodiment of the present invention.
Figure 4B:
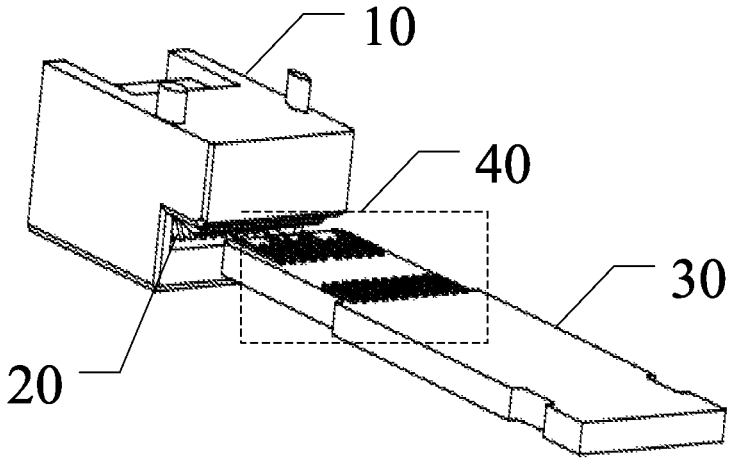

For easy understanding, the following description is based on an application scenario where the socket for the high-speed connector according to the present invention is connected to the plug. As shown in FIG. 4A and FIG. 4B, the application scenario is specifically as follows:

When the plug for the high-speed connector according to the present invention is inserted into the socket for the high-speed connector according to the present invention (the volume of the opening of the shell 10 should be slightly larger than the volume of the plug for the high-speed connector, so that the plug for the high-speed connector exactly fits into the shell 10), the positioning clip on the side of the circuit board 30 is inserted into the positioning groove on the inner wall of the shell 10, and the positions of the plug and the socket are relatively fixed.

In this case, the pin contacts inside the shell 10 are connected to the corresponding pin terminals 40 of the socket for the high-speed connector (the upper-layer pins 201 labeled in FIGS. 1 and 2 correspond to the first pin terminals, and each row of lower-layer pins 202 labeled in FIGS. 1 and 2 respectively corresponds to the second pin terminals) through crimp connection, so that the pins 20 have effective electrical connections with corresponding pin terminals; where the contact plane of the pin contacts should be consistent with the contact plane of the pin terminals in terms of size, so that the impedance of the socket matches the impedance of the plug for the high-speed connector according to the present invention during electrical connection.

After each pin terminal 40 is electrically connected to the pin 20, each signal line (including multi-channel high-speed signals) of the plug for the high-speed connector and the pins 20 of the socket for the high-speed connector are mutually connected, so that data transmission of multiple channels of high-speed signals may be efficiently performed.

The detailed description above is a socket and a plug for a high-speed connector according to the present invention. It is apparent that those skilled in the art can make various modifications and variations to the invention without departing from the spirit and scope of the invention. The invention is intended to cover the modifications and variations provided that they fall in the scope of protection defined by the following claims or their equivalents.

What is claimed is:

1. A socket for a high-speed connector comprising: a shell; and pins, wherein the shell comprises an opening configured to accommodate a plug for the high- speed connector, wherein the pins comprise upper-layer pins and lower-layer pins, wherein the upper-layer pins are set at one side of an inner wall of the opening, wherein the lower-layer pins are set at another side of the inner wall of the opening corresponding to positions of the upper-layer pins, wherein the lower-layer pins are arranged in at least two rows of pin groups, wherein the at least two rows of pin groups are distributed in a staggered manner along a length direction of the pins, and wherein a distance between centerlines of neighboring pins in one of the at least two rows of pin groups is different than a distance between centerlines of neighboring pins in another one of the at least two rows of pin groups, and wherein the upper-layer pins correspond to one row of the pin groups to enable compatibility with sockets having different terminal spacings .

2. The socket according to claim 1, wherein the upper-layer pins and the lower-layer pins comprise contacts, and wherein the contacts comprise elastic parts.

3. The socket according to claim 1, wherein an extension support is set on an inner wall of the opening, and wherein the extension support is configured to set the lower-layer pins.

4. The socket according to claim 3, wherein the upper-layer pins and the lower-layer pins comprise contacts, and wherein the contacts comprise elastic parts.

5. The socket according to claim 1, wherein the distance between neighboring pins in a row of the pin groups is 0.8 mm, and wherein the distance between neighboring pins in each of the rest of the rows of the pin groups is 0.65 mm.

6. A plug for a high-speed connector comprising: a circuit board; and pin terminals, wherein the pin terminals comprise first pin terminals and second pin terminals, wherein the first pin terminals are set on one surface of the circuit board, wherein the second pin terminals are set on another surface of the circuit board, wherein the second pin terminals are arranged in at least two rows of pin terminal groups, wherein the at least two rows of pin terminal groups are distributed in a staggered manner along a length direction of the pin terminals, and wherein a distance between centerlines of neighboring pin terminals in one of the at least two rows of pin terminal groups is different than a distance between centerlines of neighboring pin terminals in another one of the at least two rows of pin terminal groups to enable compatibility with sockets having different terminal spacings, and wherein the first pin terminals correspond to one row of the pin terminal groups.

7. The plug according to claim 6, wherein the surface of the circuit board distributed with the second pin terminals comprises a ladder structure of at least two layers, wherein the second pin terminals corresponding to the first pin terminals are distributed on a bottom plane in the ladder structure, and wherein the rest of the second pin terminals are distributed on planes of other layers in the ladder structure.

8. The plug according to claim 6, wherein the surface of the circuit board distributed with the second pin terminals comprises a ladder structure of at least two layers, wherein the second pin terminals corresponding to the first pin terminals are distributed on a bottom plane in the ladder structure, and wherein the rest of the second pin terminals are distributed on planes of other layers in the ladder structure.

9. The plug according to claim 6,wherein the distance between neighboring pin terminals in a row of the pin terminal groups is 0.8 mm, and wherein the distance between neighboring pin terminals in each of the other rows of the pin terminal groups is 0.65 mm.

10. The plug according to claim 9, wherein the surface of the circuit board distributed with the second pin terminals comprises a ladder structure of at least two layers, wherein the second pin terminals corresponding to the first pin terminals are distributed on a bottom plane in the ladder structure, and wherein the rest of the second pin terminals are distributed on planes of other layers in the ladder structure.

* * * * *